US012043429B2

(12) United States Patent
Biondi et al.

(10) Patent No.: US 12,043,429 B2
(45) Date of Patent: Jul. 23, 2024

(54) COUPLING METHOD AND UNIT FOR COUPLING A COMPONENT OF A CONTAINER TO A CONTAINER, AN APPARATUS WITH SUCH A COUPLING UNIT

(71) Applicant: G.D S.P.A., Bologna (IT)

(72) Inventors: Andrea Biondi, Bologna (IT); Luca Cavazza, Bologna (IT); Umberto Zanetti, Bologna (IT); Enrico Campagnoli, Bologna (IT); Antonio Gigante, Bologna (IT)

(73) Assignee: G.D S.P.A., Bologna (IT)

( * ) Notice: Subject to any disclaimer, the term of this patent is extended or adjusted under 35 U.S.C. 154(b) by 15 days.

(21) Appl. No.: 17/998,643

(22) PCT Filed: Jul. 26, 2021

(86) PCT No.: PCT/IB2021/056702

§ 371 (c)(1),
(2) Date: Nov. 11, 2022

(87) PCT Pub. No.: WO2022/023919

PCT Pub. Date: Feb. 3, 2022

(65) Prior Publication Data

US 2023/0348124 A1 Nov. 2, 2023

(30) Foreign Application Priority Data

Jul. 31, 2020 (IT) ..... 102020000018871

(51) Int. Cl.

| | |
|---|---|
| ***B65B 29/02*** | (2006.01) |
| ***B65B 7/28*** | (2006.01) |
| ***B65B 51/22*** | (2006.01) |

(52) U.S. Cl.
CPC ..... *B65B 29/022* (2017.08); *B65B 7/2878* (2013.01); *B65B 51/225* (2013.01)

(58) Field of Classification Search
CPC ..... B65B 29/02; B65B 61/20; B65B 29/022; B65B 51/14; B29C 65/78; B65D 81/3211
(Continued)

(56) References Cited

U.S. PATENT DOCUMENTS

2009/0211713 A1* 8/2009 Binacchi ..... B29C 66/1122 156/423
2017/0096243 A1* 4/2017 Manaresi ..... B29C 66/8322

FOREIGN PATENT DOCUMENTS

WO 2022/023919 A1 2/2022

OTHER PUBLICATIONS

International Search Report and Written Opinion for PCT/IB2021/056702 filed on Jul. 26, 2021 in the name of G.D S.P.A., mailed on Sep. 8, 2021. 12 pages.

* cited by examiner

*Primary Examiner* — Jacob A Smith
(74) *Attorney, Agent, or Firm* — Steinfl + Bruno LLP

(57) ABSTRACT

A coupling method for coupling a component of a container to the container is presented. The method includes: arranging a coupling unit including a coupling assembly with a frame, a gripping device for the component, a coupling device for constraining the component to the container; arranging the container and the component at least partially within the container, providing at least a minimum spacing between a bottom of the component and a base of the container; moving and activating the gripping device at a removal position of the component; moving the retaining element and the coupling element to a coupling position; deactivating the retaining element, thus deactivating a constraint between the gripping element and the component;
(Continued)

and activating said coupling element to produce a stable coupling between the couplable portion of the component and the container, deactivating and moving the coupling element.

19 Claims, 5 Drawing Sheets

(58) Field of Classification Search
USPC ..... 493/52, 109, 162, 56
See application file for complete search history.

COUPLING METHOD AND UNIT FOR COUPLING A COMPONENT OF A CONTAINER TO A CONTAINER, AN APPARATUS WITH SUCH A COUPLING UNIT

CROSS REFERENCE TO RELATED APPLICATIONS

The present application is the US National Stage of International Patent Application No. PCT/IB2021/056702, filed internationally on Jul. 26, 2021, which in turn, claims priority to Italian Application No. IT 102020000018871, filed on Jul. 31, 2020.

The present invention relates to a coupling unit and a coupling apparatus for coupling a component to a container, and to a coupling method of coupling them together.

In particular, the container under consideration is also configured to be used as a loose article.

The present invention finds a preferred, though not exclusive, application in the field of making loose containers such as capsules for infusion type products, for example coffee, a field to which reference may be made hereafter without loss of generality.

A coupling unit generally comprises devices suitable for constraining some parts to the object of interest.

Typically, containers in this technical field are capsule-shaped products (i.e. substantially upturned truncated conical with the widest portion upwards) and made from semi-finished polymeric materials.

Usually, these containers start to be used in various industrial processes even though they lack certain components in order to be complete and ready for use according to the final intended use, and these additional necessary components are combined during specific processing steps.

A component that is often combined with such capsule containers is a filter. This component also generally has a substantially upturned truncated conical shape, it comprises a flat circular bottom from which an inclined lateral surface projects which typically has regular and uniform corrugations called "pleats". Generally, the capsule and the filter can be produced in different materials or in different process steps so they are often made as separate and independent elements which are then mutually constrained at a certain point in order to progress to the desired final product.

Unfortunately, however, this shape engagement, particularly when the aforesaid corrugations are present on the lateral wall of the filter, can be complicated and not easily reproducible.

In addition, a number of difficulties arise from the need to retain and move the filter with respect to the capsule having certain relative reference points so as to be able to position the filter in a precise and repeatable manner exactly at the position where the coupling is to take place.

Once the coupling between the capsule and the filter has been made, this container can be filled with articles or products of interest.

In this context, a process is called "continuous" when at each time coordinate the transporter that moves the container has a speed other than zero. This speed under consideration is the speed of the transporter during any processing step leading to the coupling of the component with the container with respect to a fixed reference system and is understood as the speed of the transporter as a whole.

In this context, the term "container" identifies a structure which is formed so as to be able to contain material within it and in particular to be able to confine it at least laterally.

In this sense, the material is considered to be "laterally confined" when the shape of the container is such as to retain the material within it even when the container, in its normal condition of use by a user, is inclined with respect to the support plane by a predetermined angle.

This container can be formed by one or more walls according to the content thereof or to specific aesthetic or functional reasons. For example, the container may be a box-shaped body capable of receiving powder, liquid, gel or similar products inside.

According to another example, the container may be cup-shaped or hemispherical and thus composed by only a curved wall. In this case, this curved wall comprises a central base portion which can preferably act as a support surface and a lateral crown which extends radially from the aforesaid base portion and is shaped in such a way as to confine the product inside the container during the envisaged filling or use operations.

In this context the term "container" can be correlated with the term "capsule" of which it is considered to be a broader and more general formulation.

In this context, the term "retaining elements" identifies devices suitable for integrally constraining one or more retained portions to them in such a way that, during the retention step, any movement of the retaining element corresponds to an equal or consistent movement of the aforesaid retained portion.

In this context, a first element is defined as "engaged" with a second element when an interaction is established between the two elements such that the first element is able to determine the positioning of the second element. This interaction may be, for example, of a mechanical, magnetic or other nature.

An orientation is said "horizontal" when it is parallel to the ground plane in which the unit object of the invention is installed.

Consistently, the term "vertical" identifies a direction perpendicular to the horizontal plane and so must be understood the terms relating to "higher, lower, upward or downward" positionings or displacements that refer to an orientation along the vertical direction.

In this context, the term "selectively" indicates a method of using a device or similar technical element that allows to freely activate or deactivate it according to preference and also, in case of a plurality of usable devices being present, to select which ones to activate at the same time.

In this context, the term "stable" indicates an engagement of an object with respect to a constraint element for which this object does not change its spatial position while it is held in this way.

In this context, the term "couplable" refers to a portion that, through specific processing, can become constrained or permanently engaged with another portion. By way of a non-limiting example, it is stated that a portion can be coupled by welding, by gluing, by mutual shape engagement, etc.

The Applicant has observed that the processes generally implemented by coupling apparatuses operating on containers and components to be coupled require that they are placed immediately in contact and forcedly abutted on each other in order to ensure that there are no unknown empty spaces interposed between them.

Once this condition has been met, both the container and the component are joined together with independent retaining elements in such a way as to be able to translate them reciprocally by the desired quantity in order to bring them into the appropriate coupling configuration.

However, the Applicant has found that this methodology therefore requires at least two different specific active retaining elements, one for the component and one for the container acting simultaneously, thus increasing the complexity of the unit used.

Even more so, the Applicant has noted that such retention and movement operations are generally potentially dangerous since they are carried out by means of systems in reduced pressure in which each of them risks dragging both the container and the content therewith, thus causing considerable damage to the product being moved.

Even more, the Applicant has noted that this risk of unintentional damage to the container and/or the component by means of the retaining elements is increased when the removal of the two parts is carried out following the aforesaid forced abutting operation in which the container and the component are placed in direct contact with each other, thus creating the problematic condition that a retaining element acting on one part inadvertently constrains also the other part to itself.

The Applicant has therefore perceived that it was advantageous to start the process for coupling the container with the component starting from a different spatial configuration and trying to produce a constraint between the parts to be coupled and the retaining elements that was reproducible but at the same time not harmful to the retained parts.

As a result of this study, the Applicant has adopted an approach opposite to that in the prior art by voluntarily introducing an indeterminate space between the bottom of the filter and the base of the container.

The Applicant has finally found that the desired optimisation of the aforementioned processes is achieved by making a coupling unit of a container and a component that is able to retain them simultaneously, to move them reciprocally while minimising the damage introduced and to couple them effectively when brought into a predetermined reciprocal position.

In particular, in a first aspect thereof, the invention relates to a method for coupling a component of a container to said container.

Preferably, this method comprises arranging a coupling unit comprising a coupling assembly.

Preferably, such a coupling assembly comprises a frame.

Preferably, this coupling assembly comprises a gripping device constrained with possibility to move relative to said frame and comprising a retaining element configured to retain said component selectively.

Preferably, this coupling assembly comprises a coupling device constrained with possibility to move relative to said frame and comprising a coupling element configured to constrain said component to said container.

Preferably, said coupling element is configured to constrain said component to said container at a predetermined coupling position of said component relative to said container.

Preferably, this coupling assembly comprises a retaining seat constrained to said frame and shaped in such a way that it may house said container in a stable manner.

Preferably, this method comprises arranging said container in said retaining seat and said component at least partially within said container so that there is at least a predetermined minimum spacing other than zero between a bottom of said component and a base of said container.

Preferably, this method comprises positioning said gripping device and said coupling device at an initial position wherein both are at an initial spacing from said bottom of said component. Preferably, this method comprises moving said gripping device to a removal position in which said gripping device is positioned near or in contact with said component and activating said retaining element in such a way as to selectively constrain said component to said retaining element.

Preferably, said movement of said gripping device at said removal position always takes place while maintaining a safety spacing other than zero from said base such that said bottom never touches said base.

Preferably, this method comprises moving said gripping element and said coupling element to a coupling position in which a predetermined couplable portion of said component is placed in contact with said container.

Preferably, this method comprises deactivating said gripping element and thus deactivating the constraint between said gripping element and said component.

Preferably, this method comprises activating said coupling element for a predetermined coupling time so as to produce a stable coupling between said couplable portion of said component and said container.

Preferably, this method comprises deactivating said coupling element.

Preferably, this method comprises moving said gripping element and said coupling element away from said component at an end position.

In this way it is possible to apply an intense force through the retaining element substantially only on the component. In this sense, therefore, the predetermined minimum spacing created between the portion to be retained of the component and the container makes it possible to produce a very effective, safe and reproducible retention that allows obtaining a zeroing between the retaining element and the portion to be retained of the component, bringing the retaining element and the portion to be retained of the component into contact and without affecting or deforming the container. Thanks to this technical solution, it is therefore possible to preserve the container in an ideal manner, to avoid moving it by leaving it permanently in a fixed and predetermined position and to guarantee a high retention efficiency of the gripping device, which makes it possible to zero the spacing by constraining by contact the portion of the component to be retained, thus defining a certain positioning of the component for all the following desired process phases.

In a second aspect thereof, the invention relates to a coupling unit comprising a coupling assembly comprising a frame.

Preferably, said assembly comprises a gripping device.

Preferably, said gripping device is constrained with allowed movement relative to said frame.

Preferably, said gripping device comprises a retaining element configured to retain said component selectively.

Preferably, said assembly comprises a constrained coupling device with allowed movement relative to said frame.

Preferably, said coupling device comprises a coupling element configured to constrain said component to said container at a predetermined coupling position of said component relative to said container.

Preferably, said assembly comprises a retaining seat which is constrained with impeded vertical translation to said frame.

Preferably, said retaining seat is shaped in such a way that it may house said container in a stable manner so that said component may be moved relative to said container which is stationary.

Preferably said container is permanently constrained in said seat and said component is at least partially housed within said container so that there is at least a predetermined minimum non-zero spacing between a bottom of said component and a base of said container.

In this way it is possible to apply an intense force through the retaining element substantially only on the component. In this sense, therefore, the predetermined minimum spacing created between the portion to be retained of the component and the container makes it possible to produce a very effective, safe and reproducible retention that allows obtaining a zeroing between the retaining element and the portion to be retained of the component, bringing the retaining element and the portion to be retained of the component into contact and without affecting or deforming the container. Thanks to this technical solution, therefore, it is possible to create a coupling unit that is structurally and functionally provided with elements that make it possible to produce a constraint between the component and the container, avoiding moving the latter during the work phases and thus reducing the possibility of the damage or undesirable movement, while at the same time guaranteeing a high level of retention efficiency with allowed movement of only the component, making it possible to ensure the position thereof with respect to the retaining element so as to be able to produce a reproducible and advantageous coupling step between the desired portions.

In a third aspect thereof, the invention relates to an article production apparatus comprising at least one coupling unit made in accordance with the aforesaid second aspect.

In at least one of the above-mentioned aspects, the present invention may also have at least one of the preferred features described below.

Preferably, said safety spacing is greater than or equal to said minimum spacing.

Preferably, said retaining element is engaged on or near said bottom of said component.

Preferably, said container is a capsule and said component is a capsule filter. Thanks to this technical solution, the filter can be firmly constrained without damage inside the capsule, guaranteeing high precision and reproducibility of the process.

Preferably, said capsule has a substantially upturned truncated conical shape and has a flat or curved lower surface acting as a base and an upper opening suitable for inserting, for example, a filter or products to be contained (powders, liquids, gels, etc.).

Alternatively, said a capsule may be a substantially box-shaped container of various sizes.

Preferably, said capsule may be made of multilayer material, e.g. materials that are composed of layers of PP (Polypropylene) and/or EVOH (Ethylene Vinyl Alcohol) in PET (Polyethylene Terephthalate) or PS (Polystyrene). Otherwise capsule is made of multilayer material with at least one metal alloy layer, e.g. aluminium-based.

Preferably, said filter also has a substantially upturned truncated conical shape, has a flat or curved bottom, a lateral wall projecting from said bottom and an upper opening defined by said lateral wall suitable for allowing the insertion of desired products (powders, liquids, gels, etc.).

Preferably, said lower bottom is circular in shape.

Preferably, said lateral wall of said filter has vertically aligned uniform corrugations known as pleats.

Alternatively, said a component may be, for example, a lid or a label to be applied to a container.

Preferably, said component is made of a filter material, e.g. cellulose-based material mixed with heat-sealable material such as PS (polystyrene) or PLA (poly-lactic acid).

Preferably, said container is housed in said unit so as to remain substantially vertical.

In other words, said container has a base at the bottom.

This makes it easier and more effective to retain the elements within it.

Preferably, the component, especially when it is a truncated conical filter or similar shapes, is also retained so that it remains substantially vertical.

In other words, the bottom of said component at the bottom.

This makes it easier and more effective to retain the elements within it. Preferably, said method comprises moving at least said gripping device away from said base of said container at a predetermined engagement position of said gripping device.

Preferably, said engagement position provides that a coupling configuration of said retaining element relative to said coupling element before carrying out said movement towards said coupling position may be assumed.

In this way it is possible to realise a desired coupling configuration that provides for a synergic collaboration between said coupling element and said retaining element.

Thanks to this solution it is possible to ensure that the coupling element is placed in the ideal position with respect to the retaining element and that it can adapt or modify the shape of said component so as to make it more effectively usable in the following processing steps.

Preferably, at least one of said steps of moving towards said engagement position, activating the coupling element, deactivating and moving towards the final position is performed while maintaining said coupling configuration between said retaining element and said coupling element.

In this way, the desired process step benefits from the above-mentioned synergy produced by the coupling configuration.

Preferably, all of said steps of moving towards said engagement position, coupling position, activation of the coupling element, deactivation and movement towards the final position are performed while maintaining a spacing between said bottom and said base greater than said safety spacing.

Preferably, said coupling element is a welder which comprises a conical or truncated cone-shaped portion tapered towards said container.

Preferably, said conical or truncated cone-shaped end portion tapered towards said container has a diameter greater than the maximum dimension of said retaining element and of said bottom of said component.

Thanks to this technical solution, it is possible to engage a portion of the inclined lateral wall of said welder on the component so as to increase its horizontal width as desired, thus facilitating and improving the possibility of engagement on the container.

Preferably, said engagement position is identified in a portion of space in which said component is at least partially external to said container so that said coupling configuration can be achieved without damaging said component or said container.

Thanks to this technical solution, it is also possible to significantly modify the shape of the component so as to further increase its ability to engage effectively on the container and to facilitate its subsequent partial insertion into it by ensuring an appropriate contact.

Preferably, said coupling element is a thermal or ultrasonic welder.

Thanks to this technical solution, the coupling produced is a welding that identifies a stable and durable type of constraint.

Preferably, when said coupling element is a welder of the ultrasonic type, before said step of moving said gripping element and said coupling element towards said final position said coupling element produces an ultrasonic pulse so as to further disengage said component from said coupling element.

This optimises the step of release of the component with respect to the retaining element and also produces an additional self-cleaning of the welder, which detaches more neatly.

Preferably, said method comprises positing a counter-welder external to said container that abuts against said container at said coupling portion when said coupling element is active and in contact with said coupling portion of said component.

This makes it possible to achieve even more effective welding between the component and the container.

Preferably, said final position coincides with said initial position.

In this way, the aforesaid method can be implemented more functionally and quickly.

Preferably, said coupling unit comprises a transporter on which said assembly is housed and said method is carried out continuously.

Thanks to this technical solution, the container movement step thus creates a single, uninterrupted and continuous flow of movement and processing. This reduces the necessary accelerations and decelerations of the various devices as they move with the assembly housed on the transporter, significantly increasing the average service life of the various mechanical components and reducing the possibility of undesirable collisions between moving parts of the assembly and superimposed parts external thereto.

Preferably, said retaining element works in reduced pressure.

Thanks to this solution, it is possible to draw the component onto the retaining element even if they are not necessarily in direct contact and to constrain them firmly and solidly for the desired time.

Preferably said element in reduced pressure is a suction cup or similar technical devices.

Preferably, said minimum spacing is between 2 and 20 millimetres. Even more preferably, said minimum spacing is between 2 and 15 millimetres.

In this way it can be ensured that the retaining element acts primarily on the component only.

Preferably, said coupling position of said coupling element is between 5 and 15 mm from said base of said container.

In this way, an effective positioning of the component with respect to the container is achieved.

Preferably, said sealing temperature is indicatively between 150° C. and 300° C. for a coupling time between 0.1 sec. and 0.8 sec.; the coupling time can be even more preferably about 0.4 sec.

In order to weld correctly, a welding force must be applied between the elements to be welded for them to join. Preferably, the welding force is between 300 and 700 N. The welding force applied varies according to the materials to be welded.

This produces an ideal thermal welding and optimises the expected process times.

Preferably, said welding power is between 300 W and 700 W for a coupling time between 0.1 and 0.4 seconds.

This produces an ideal ultrasonic welding and optimises the expected process time.

Preferably, said gripping device and said coupling device are constrained to said frame with allowed translation.

This makes it possible to produce an ideal minimum movement.

Preferably said translation is vertical.

Thanks to this solution, it is possible to implement said method by significantly reducing the possibility that a content may come out of the container and/or component.

Preferably, said gripping device is configured to be movable only in positions which determine a spacing between said bottom and said base greater than or equal to said predetermined minimum spacing.

This configuration can be achieved by means of structural stroke limit elements included in said gripping device or by means of specific movement limits set and managed at software level.

Preferably, said retaining seat, said retaining element and said coupling element are coaxially aligned vertically with each other.

In this way it is possible to carry out the planned steps by means of a simple vertical movement and containing the steric overall dimension.

Preferably, said retaining element comprises a cylindrical rod which is coaxial and slides within said coupling element which in turn comprises a hollow cylindrical body in which said cylindrical rod of said retaining element slides. This makes it possible to minimise the spaces required by reducing the overall dimensions of the coupling assembly.

Preferably, said coupling element is a thermal or ultrasonic welder.

Preferably, said coupling element is a welder which comprises a conical or truncated cone-shaped portion tapered towards said container and has a diameter greater than the maximum dimension of said retaining element and of said bottom of said component.

Preferably, said coupling unit comprises a plurality of said coupling assemblies. This can significantly increase the productivity of the unit itself.

Preferably, said plurality of said coupling assemblies are mutually spaced at an angular pitch.

This optimises the spatial distribution of said plurality of coupling units.

Preferably, said retaining seat is defined by two horizontally movable or rotatable pincers.

This facilitates the insertion and removal of said container within said seat.

Alternatively, said retaining seat may be defined by a translatable or rotatable pincer and a fixed pincer or seat.

This rotation movement can be achieved by means of cam type mechanisms.

Alternatively, this retention seat may be included in a second mobile gripping device.

Preferably, said coupling unit comprises a transporter on which said assembly is constrained.

In this way, while the coupling process takes place, the container is moved from a first processing zone to a second processing zone, thereby optimising process times.

Preferably, said transporter is a rotary carousel.

This minimises the space required and ensures that, with the same direction of rotation of said carousel, it is possible to pass continuously and uninterruptedly between said first and second processing zones, thereby further increasing the productivity of the coupling unit.

Preferably, said coupling is made during a rotation between 60° and 180° of said rotary carousel. Even more preferably, said coupling is made during a rotation of approximately 120° of said rotary carousel.

This further increases the productivity of the coupling unit by balancing the angular speed of rotation of the carousel with the relative movements of said gripping element and coupling element.

The characteristics and advantages of the invention will become clearer from the detailed description of an embodiment illustrated, by way of non-limiting example, with reference to the appended drawings wherein.

Figures 1, 2, 3:
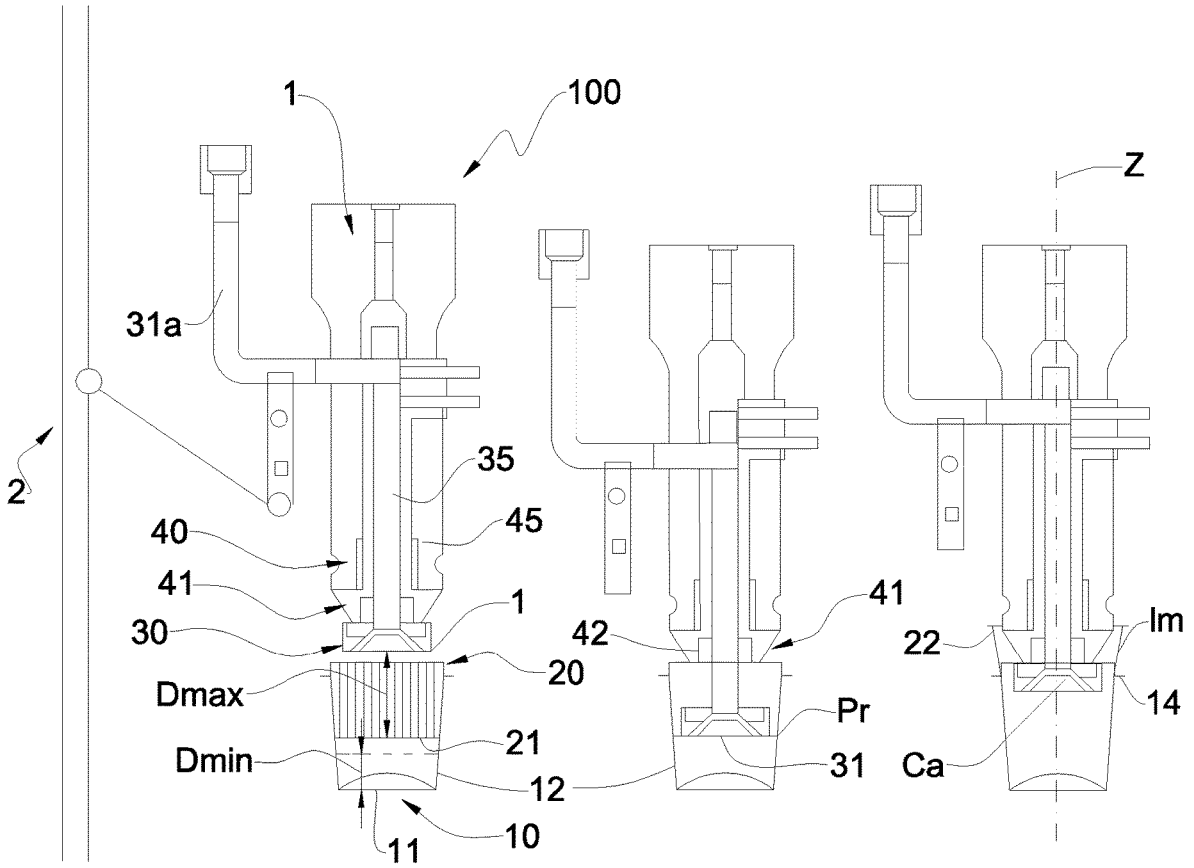
FIG. 1 is a schematic side view of a coupling assembly in an initial position made in accordance with the present invention.
FIG. 2 is a schematic side view of the coupling assembly of FIG. 1 in the removal position.
FIG. 3 is a schematic side view of the coupling assembly of FIG. 1 in the engaged position.
Figure 9A:
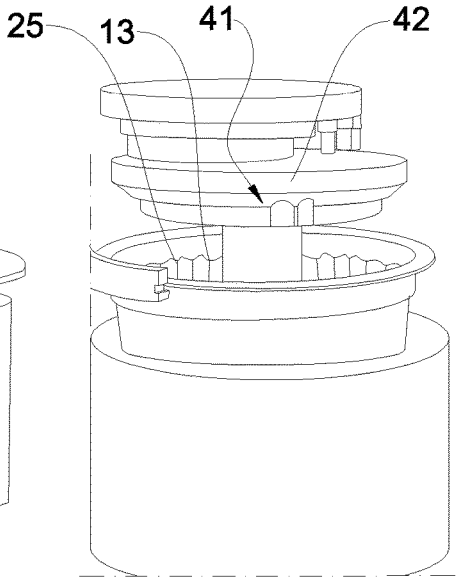
Figure 9B:
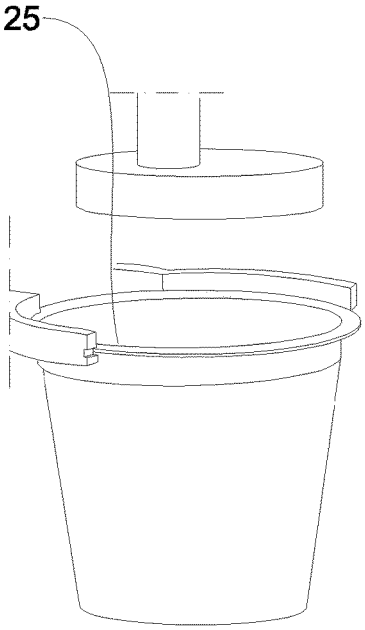
Figure 10:
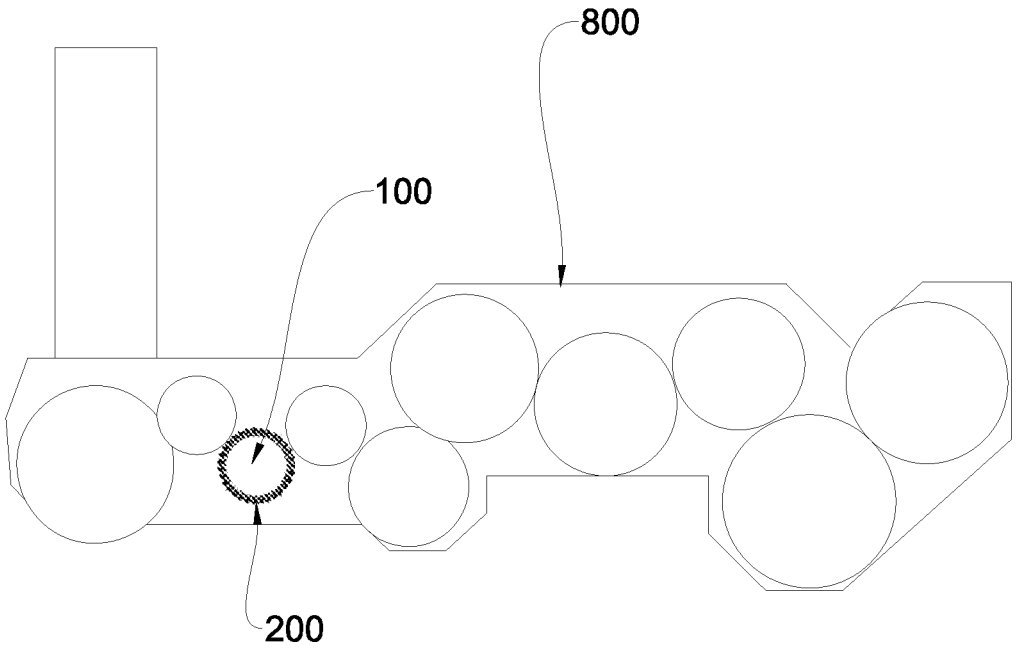

FIG. 9*a* is a perspective view of FIG. 1 coupling assembly after the coupling position;

FIG. 9*b* is a perspective view of the coupling assembly of FIG. 1 in the final position;

FIG. 10 is a schematic view from above of an article production apparatus according to the present invention.

With initial reference to FIG. 10, 800 refers to a production apparatus provided to form and fill a container with a desired product, so as to obtain a finished container, ready to be packaged or used.

The embodiment example described below refers to containers 10 in the form of capsules on which a component 20 in the form of a filter is coupled.

In the specific case described herein, the containers 10 are capsule type elements for the preparation of beverages by infusion, in particular coffee capsules.

In the present example and as depicted in FIGS. 1-9*b*, the capsule 10 has a substantially upturned truncated conical shape presenting a base 11 of substantially flat and circular shape from which a lateral wall 12 is transversely projected.

Figure 6:
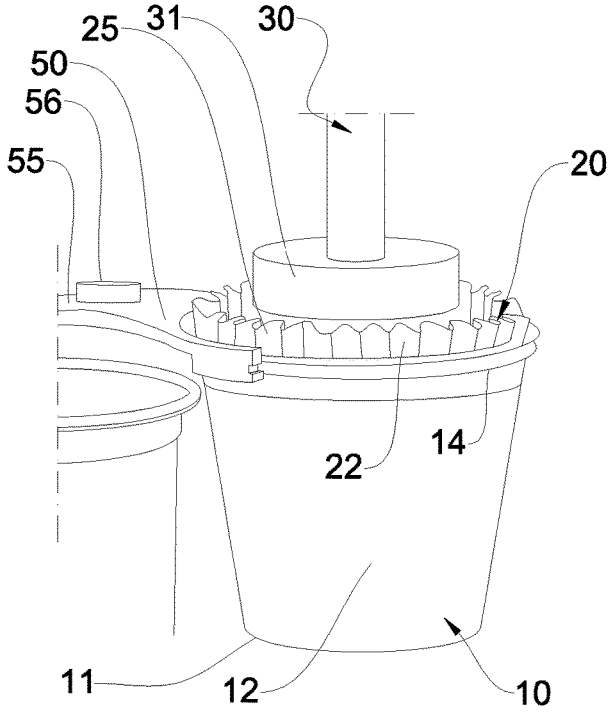
FIG. 6 is a perspective view of the coupling assembly of FIG. 1 in the initial position.

This lateral wall 12 as shown, for example, in FIGS. 1 and 6 is inclined with respect to the vertical line having the smaller diameter thereof at the base 11 and the larger diameter thereof at an upper opening 13.

Again with reference to FIGS. 1 and 6, it can be seen that the lateral wall 12 of the container 10 ends at the top with an edge 14 projecting radially outward the container 10 itself.

Figure 5:
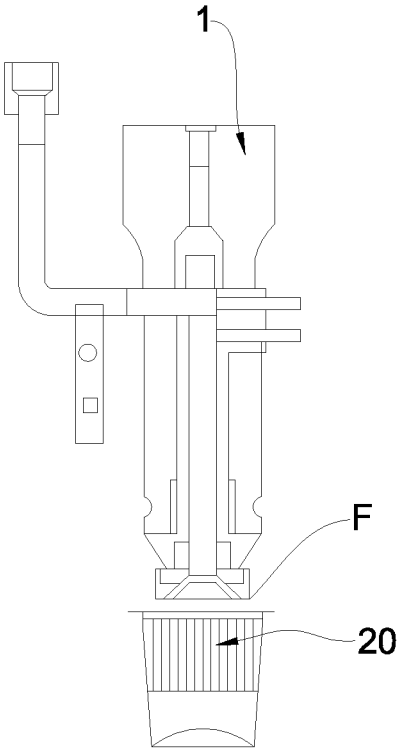
FIG. 5 is a schematic side view of the coupling assembly of FIG. 1 in the final position.

As shown in FIGS. 1 and 5, the filter 20 also has a substantially upturned truncated conical shape and has a substantially flat and circular bottom 21 from which a side surface 22 transversely projects.

In FIGS. 1 and 10, 100 identifies a coupling unit comprising a coupling assembly 1 and a transporter 200 in the form of a rotary carousel.

More specifically, said coupling assembly 1 comprises a frame 2, a gripping device 30 and a coupling device 40.

Even more in detail and with reference to FIG. 2, the gripping device 30 comprises a retaining element 31 and the coupling device 40 comprises a coupling element 41.

The retaining element 31 represented is a suction cup operating in reduced pressure.

With reference to FIGS. 1 and 2, it can be seen that this gripping device 30 also comprises a vacuum system 31*a* fluid-dynamically connected to the suction cup 31 by means of a vertical hollow cylindrical rod 35 which is coaxial with the coupling device 40 and which slides within a hollow body 45 included in the coupling element 41.

In fact, the hollow body 45 has a substantially cylindrical shape within which the cylindrical rod 35 connected to the suction cup 31 translates vertically.

With reference to FIGS. 1 to 5, the suction cup 31 is always positioned inferiorly with respect to the hollow body 45 and has a circular development with a maximum diameter which is greater than the through hole in said hollow body 45.

It is also significant to consider that interposed between the hollow body 45 and the suction cup 31 there is a head 42 which is depicted in FIGS. 1-9*b* as a portion of a thermal welder.

With reference to FIG. 9*a*, this head 42, which identifies the heatable portion of the thermal welder that can be activated, for example, by means of thermoresistors, also has an upturned truncated conical shape in which the diameter of the smaller circular base is towards the bottom 21 of the filter 20.

Alternatively, in embodiments not shown in the figures, the heating portion of the thermal welder corresponds to a lower portion of the hollow body 45.

Still alternatively, in embodiments not shown in the figures, the coupling element 41 is an ultrasonic welder and the head 42 does not act as a directly vibrating part but simply as an insertion cone suitable for abutting against the filter 20. In this case, the ultrasonic welding device is preferably housed in the hollow body 45 and brings it into vibration in order to perform the welding of the filter 20 on the capsule 10.

Again with reference to FIGS. 1-3, the head 42 is connected to the coupling device 40 through a tube which is also hollow and is coaxially interposed between said hollow body 45 and said cylindrical rod 35.

In this way, the head 42 can be translated independently with respect to the suction cup 31 according to the desired process steps.

These considerations are similarly valid in the case where the coupling element 41 performs an ultrasonic welding, considering however that, in this situation, the head 42 acts only as an abutment element on the filter 20 while the devices in charge of producing the ultrasounds are included inside the hollow body 45. According to these embodiments, it will be possible for the entire hollow body 45 included in the coupling element 41 to translate as required.

Figure 4:
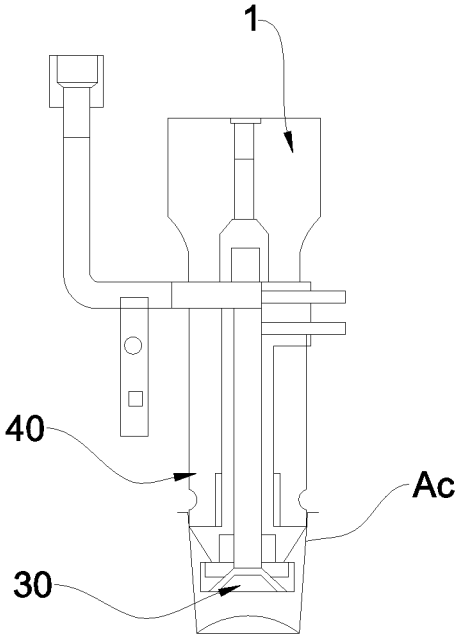
FIG. 4 is a schematic side view of the coupling assembly of FIG. 1 in the coupling position.

In more detail and as shown in FIGS. 3-5, the retaining element 31 and the coupling element 41 may translate reciprocally along a vertical axis Z and assume a coupling configuration Ca in which they are at a predefined mutual spacing which is represented in the aforesaid figures as being equal to zero.

It is advantageous to be able to maintain such a coupling configuration Ca in all desired following process steps, including the welding step as shown in FIG. 4, since in this way one is certain of the mutual arrangement between the suction cup 31 and the head 42 (and more generally of the coupling element 41) and consequently also of the position and shape of the filter 20.

Again with reference to FIG. 6, it can be seen that the coupling assembly 1 comprises a retaining seat 50 positioned below with respect to the gripping device 30 when in its highest position along the axis Z.

This seat 50 is a substantially horizontal groove or recess of semi-circular shape made inside two pincers 55 each rotatable around a respective pin 56 having a rotation axis parallel to the vertical axis Z.

Again with reference to FIG. 6, it can be seen that the seat 50 is dimensioned in such a way as to be able to house within it at least a portion of the edge 14 of the container 10 in order to realise a stable constraint between the container 10 and the coupling unit 100 itself.

In this way, the container 10 is always firmly constrained and housed during all processing steps of this coupling method.

In order to remove the container 10, it is sufficient to rotate the pincers 55 in mutually opposite directions of rotation so as to open and remove the constraint acting on the container 10 itself.

With reference to FIGS. 1 and 6, it can be noted that the suction cup 31 and the head 42 are at the beginning of this method at the initial spacing Dmax from the bottom 21 of the filter 20 at an initial position I and that at the same time the filter 20 is only partially housed inside the capsule 10 thus determining a predetermined minimum spacing Dmin other than zero between the bottom 21 of the filter 20 and the base 11 of the capsule 10.

At this point and with reference to FIG. 2, the suction cup 31 descends vertically towards the capsule 10, thus intercepting the filter 20.

As the suction cup 31 descends, the vacuum system 31*a* is activated and the filter is drawn by reduce pressure towards the suction cup 31, which starts to retain it firmly and solidly.

At this point, and with reference to FIG. 3, the suction cup 31 rises vertically up to the engagement position Im, where it cooperates synergistically with the head 42.

It can also be noted from FIG. 3 that as the suction cup rises vertically, the head 42 descends slightly to meet the suction cup and the lateral surface 22 of the filter 20.

In this way, the upturned truncated conical shape of the head 42 pushes the lateral surface 22 of the filter 20 outwards, deforming it slightly and preparing it even more effectively for the following welding on the capsule 10.

It is interesting to note that at this point the head 42 is engaged on the lateral surface 22 at or near a couplable portion 25 of the filter 20.

This couplable portion 25 is the portion which will be heated by the head 42 and welded to the lateral wall 12 of the capsule 10.

At this point and with reference to FIG. 4, the suction cup 31 and the head 42 move together maintaining the same mutual engagement and reach the coupling position Ac in which the predetermined couplable portion 25 of the filter 20 is placed in contact with the capsule 10.

Figure 7:
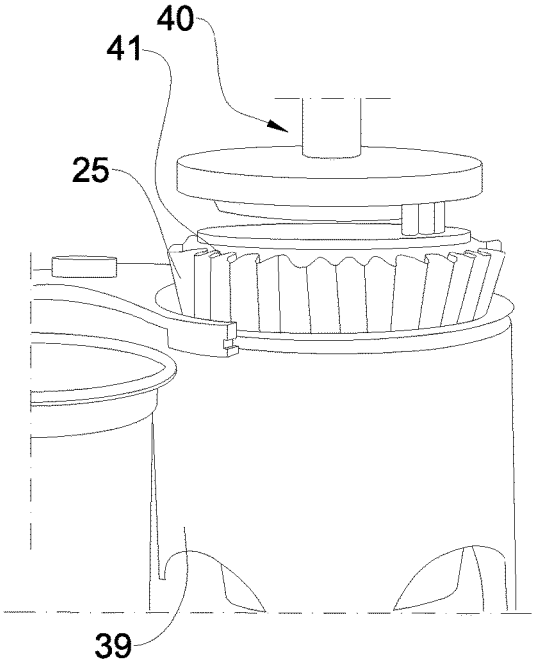
FIG. 7 is a perspective view of the coupling assembly of FIG. 1 in the engaged position.

As shown in FIG. 7 while the suction cup 31 reaches the engagement position Im a counter-welder 39 external to said capsule 10 rises vertically from a rest position, in which it was positioned inferiorly with respect to the capsule 10, up to an abutment position so as to abut against said capsule 10 at the coupling portion 25 when the head 42 is in contact with the coupling portion 25 itself.

Figure 8:
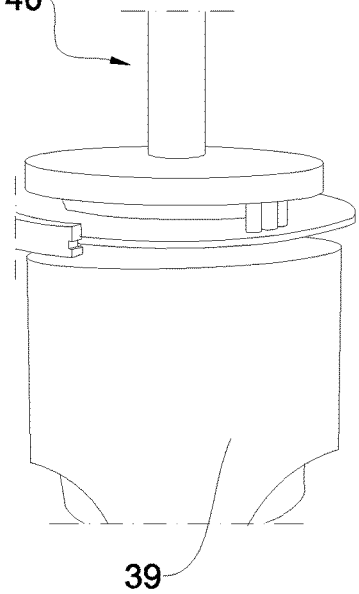
FIG. 8 is a perspective view of the coupling assembly of FIG. 1 in the coupling position.

With reference to FIG. 8, it can be noted that the head 42 is activated and the couplable portion 25 of the filter 20 is heated while the suction cup 31 continues to be active and the counter-welder 39 in the abutment position.

The welding is carried out for a predetermined coupling time between 0.1 and 0.8 seconds at a head temperature between 150 and 300° C.

After this coupling time the head 42 is deactivated and the suction cup 31 is also deactivated.

FIGS. 5 and 9*b* show the suction cup 31 and the head 42 translating solidly vertically away from the bottom 21 of the filter 20 and from the couplable portion 25 towards a final position F.

Advantageously, the final position F coincides with the initial position I.

As can be noted from FIG. 10, a plurality of coupling assemblies 1 is mounted on a transporter 200 having the form of a rotary carousel.

The plurality of coupling assemblies used is equal to 32.

This plurality of assemblies is arranged at an angular pitch on the rotary carousel 200.

The processing steps leading to the welding of the filter 20 on the capsule 10 cover a rotation arc which varies between 160° and 270°, more preferably 240°.

In particular, the welding step of the filter on the capsule takes place on a rotating arc of the rotary carousel 200 which varies between 60° and 180°, more preferably 120°.

Thanks to these technical solutions, the Applicant has found that it is possible to couple at least 800 up to 2000 containers per minute, depending on the dimensions, the overall dimensions and the production needs, with a single-line coupling unit.

The invention claimed is:

1. A coupling method for coupling a component of a container to said container, the method comprising arranging a coupling unit comprising a coupling assembly, the coupling assembly comprising:

a frame, a gripping device moveably constrained to said frame, the gripping device comprising a retaining element configured to selectively retain said component, a coupling device moveably constrained to said frame, the coupling device comprising a coupling element configured to constrain said component to said container at a predetermined coupling position of said component relative to said container, and a retaining seat constrained to said frame and configured to stably house said container;

arranging (i) said container in said retaining seat and (ii) said component at least partially within said container, providing at least a predetermined minimum spacing between a bottom of said component and a base of said container;

positioning said gripping device and said coupling device at an initial position in which said gripping device and said coupling device are at an initial spacing from said bottom of said component;

moving said gripping device to a removal position in which said gripping device is positioned near or in contact with said component, and activating said retaining element to selectively constrain said component to said retaining element, maintaining at all times a safety spacing from said base, preventing said bottom from touching said base;

moving said retaining element and said coupling element to a coupling position in which a predetermined couplable portion of said component is placed in contact with said container;

deactivating said retaining element, thus deactivating a constraint between said gripping element and said component;

activating said coupling element for a predetermined coupling time to produce a stable coupling between said couplable portion of said component and said container;

deactivating said coupling element; and moving said retaining element and said coupling element away from said component to a final position.

2. The method according to claim 1, further comprising, before moving said retaining element and said coupling element to a coupling position:

moving at least said gripping device away from said base of said container to a predetermined engagement position of said gripping device to assume a coupling configuration of said retaining element relative to said coupling element.

3. The method according to claim 2, wherein at least one of said steps:

moving towards said predetermined engagement position, moving to said coupling position, activating of the coupling element, deactivating said coupling element, and moving to the final position are performed while maintaining said coupling configuration between said retaining element and said coupling element.

4. The method according to claim 1, wherein said coupling element is a welder comprising a conical or truncated cone-shaped portion tapered towards said container, having a diameter greater than a maximum dimension of said retaining element and of said bottom of said component.

5. The method according to claim 4, wherein said coupling element is a thermal or ultrasonic welder.

6. The method according to claim 5, wherein when said coupling element is an ultrasonic welder, before said step of moving said retaining element and said coupling element to said final position, said coupling element produces an ultrasonic pulse to further disengage said component from said coupling element.

7. The method according to claim 1, comprising:

positioning a counter-welder external to said container, the counter-welder abutting against said container at said couplable portion when said coupling element is active and in contact with said couplable portion of said component.

8. The method according to claim 1, wherein said final position coincides with said initial position.

9. The method according to claim 1, wherein said coupling unit comprises a transporter on which said assembly is housed.

10. The method according to claim 1, wherein said retaining element operates in a reduced pressure regime.

11. A coupling unit for performing the method according to claim 1, the coupling unit comprising at least one coupling assembly, each at least one coupling assembly comprising:

a frame, a gripping device moveably constrained to said frame, the gripping device comprising a retaining element configured to selectively retain said component, a coupling device moveably constrained to said frame, the coupling device comprising a coupling element configured to constrain said component to said container at a predetermined coupling position of said component relative to said container, and a retaining seat constrained to said frame with impeded vertical translation relative to said frame and configured to stably house said container, so that said component is moveable relative to said container, said container being stationary, said container being stably constrained in said retaining seat and said component being at least partially housed within said container, providing at least a predetermined minimum spacing between a bottom of said component and a base of said container.

12. The coupling unit according to claim 11, wherein said retaining seat, said retaining element and said coupling element are coaxially aligned vertically with each other.

13. The coupling unit according to claim 11, wherein said retaining element comprises a cylindrical rod coaxial with and sliding within said coupling element, and said coupling element comprises a hollow cylindrical body in which said cylindrical rod of said retaining element slides.

14. The coupling unit according to claim 11, wherein said coupling element is a welder comprising a conical or truncated cone-shaped portion tapered towards said container and having a diameter greater than a maximum dimension of said retaining element and of said bottom of said component.

15. The coupling unit according to claim 11, wherein said coupling element is a thermal or ultrasonic welder.

16. The coupling unit according to claim 11, wherein the at least one coupling assembly are a plurality of coupling assemblies mutually spaced at an angular pitch.

17. The coupling unit according to claim 11, comprising a transporter on which said coupling assembly is constrained.

18. The coupling unit according to claim 17, wherein said transporter is a rotary carousel.

19. An article production apparatus comprising at least one coupling unit according to claim 11.

* * * * *